US009038859B2

(12) United States Patent
Van Diepen et al.

(10) Patent No.: US 9,038,859 B2
(45) Date of Patent: May 26, 2015

(54) CONTAINER ASSEMBLY FOR USE WITH A DISPENSER

(71) Applicant: Reckitt Benckiser N.V., WT Hoofddorp (NL)

(72) Inventors: Jacobus Simon Petrus Van Diepen, Dongguan (CN); Steve Piantoni, Windsor (GB); Peter Rickett, Windsor (GB)

(73) Assignee: Reckitt Benckiser N.V., WT Hoofddorp (NL)

( * ) Notice: Subject to any disclaimer, the term of this patent is extended or adjusted under 35 U.S.C. 154(b) by 41 days.

(21) Appl. No.: 14/025,048

(22) Filed: Sep. 12, 2013

(65) Prior Publication Data

US 2014/0008393 A1 Jan. 9, 2014

Related U.S. Application Data

(63) Continuation of application No. 13/990,967, filed as application No. PCT/GB2011/052416 on Dec. 7, 2011, now abandoned.

(30) Foreign Application Priority Data

Dec. 8, 2010 (GB) ..... 1020777.7

(51) Int. Cl.

| | |
|---|---|
| ***B65D 49/00*** | (2006.01) |
| ***B05B 11/00*** | (2006.01) |
| ***B05B 15/00*** | (2006.01) |
| ***B65D 49/02*** | (2006.01) |

(52) U.S. Cl.

CPC ..... *B05B 11/0008* (2013.01); *B05B 11/0097* (2013.01); *B05B 15/005* (2013.01); *B65D 49/02* (2013.01)

(58) Field of Classification Search

CPC ..... B05B 11/0008; B65D 49/00; B65D 49/02

USPC ..... 222/147, 464.1, 382, 321.1, 222/321.6–321.9, 383.1, 383.3; 215/14–30

See application file for complete search history.

(56) References Cited

U.S. PATENT DOCUMENTS 704,613 A * 7/1902 Buttner ..... 215/21
879,000 A * 2/1908 Pitner ..... 222/147

(Continued)

FOREIGN PATENT DOCUMENTS

GB 2133502 A * 7/1984
GB 2329892 A 4/1999

(Continued)

OTHER PUBLICATIONS

Notification of Transmittal of the International Search Report and the Written Opinion of the International Searching Authority for PCT/GB2011/052416 dated Mar. 27, 2012.

(Continued)

*Primary Examiner* — Donnell Long

(74) *Attorney, Agent, or Firm* — Norris McLaughlin & Marcus PA

(57) ABSTRACT

A container assembly for use with a dispenser with a feed tube, the assembly comprising a container; a cap fixed to an opening in the container; the cap having a passageway therethrough to allow, in use, the feed tube of a dispenser to pass through the cap and into the container; the cap including a movable element secured to the cap in a first position prior to first insertion of the feed tube by a deformable support element arranged to deform upon insertion of the feed tube into the cap to free the movable element to be supported, in use, in a second position, by the feed tube to preserve the passageway, the movable element being configured to move, upon removal of the feed tube from the container, to a third position at least partially within the passageway in which replacement of the feed tube through the cap is obstructed.

7 Claims, 4 Drawing Sheets

(56) References Cited

U.S. PATENT DOCUMENTS

| | | | | | |
|---|---|---|---|---|---|
| 1,990,076 | A | * | 2/1935 | Kanz | 215/21 |
| 2,476,587 | A | * | 7/1949 | Doblin | 215/19 |
| 3,985,332 | A | * | 10/1976 | Walker | 251/111 |
| 4,154,369 | A | | 5/1979 | Morane | |

FOREIGN PATENT DOCUMENTS

| | | | |
|---|---|---|---|
| WO | 9214063 | A2 | 8/1992 |
| WO | 2005099909 | A1 | 10/2005 |

OTHER PUBLICATIONS

International Search Report PCT/GB2011/052416 dated Mar. 27, 2012.

Written Opinion of the International Searching Authority for PCT/GB2011/052416 dated Mar. 27, 2012.

GB Search report for 1020777.7 dated Mar. 10, 2011.

* cited by examiner

CONTAINER ASSEMBLY FOR USE WITH A DISPENSER

This is a continuation patent application of U.S. Ser. No. 13/990,967 filed May 31, 2013, which in turn was an application filed under 35 USC 371 of PCT/GB2011/052416.

The present invention relates to a container assembly containing a flowable composition which is used to supply the composition to a dispenser of the type having a feed tube.

Such dispensers include soap dispensers of the type having a pump action mechanism which is either manually activated or automatically activated upon sensing of a user's hands in the vicinity of the dispenser. The dispenser may dispense any suitable flowable composition such as soap, shampoo, shower gel, conditioner, alcohol gel, toothpaste, hand cream, moisturiser and the like. The dispenser may be of the well-known spray dispenser type generally used for dispensing cleaning products and the like having a dip tube which leads from the bottom of the container out through a cap to convey liquid to a spray mechanism which is mounted on the top of the bottle. Such containers commonly have a trigger actuated spray, but may have a different type of pump mechanism, such as a rotary mechanism.

The dispenser may also find use in other applications such as food, for the dispensing of tomato ketchup, mustard and the like. In all cases, a container containing the flowable composition is attached to the dispenser having the feed tube such that it effectively provides a refill for the dispenser.

Many such containers are known. In most cases, the container can be detached from the dispenser and refilled and re-used. Pump dispensers are known for example from WO 2005/099909 which discloses a pump dispenser and a sealed cartridge inserted into the container which cartridge is broken by a dip-tube. It is also known to provide closures for bottles where a portion is destroyed by an inserted dispensing tube and which provides a tamper evident closure (GB-A-2 329 892).

In certain circumstances, it is undesirable to allow the container to be refilled. Allowing a container to be refilled can result in the refill being filled with material which is incompatible with the dispenser such that it clogs or otherwise damages the dispenser. It could also be dangerous if a container labelled as containing one particularly substance is refilled with a different substance that the user is unaware of. Also, if the container initially filled with a branded product, it could be refilled with an inferior product thereby misleading consumers.

There is therefore a need, in certain circumstances, for a container assembly which can be used with a dispenser with a feed tube which cannot be refilled.

An attempt in the prior art to provide such an arrangement is described in U.S. Pat. No. 4,154,369. In this, the feed tube is effectively a two-part construction. The lower part extends from a cap at the top of the container towards the bottom of the container. The upper part is provided on the spray mechanism and is removable together with the spray mechanism. Between the two parts is a narrow orifice which is stated as being inadequate to allow the container to be refilled. This arrangement suffers from a number of drawbacks. Firstly, the upper end of the lower part of the feed tube and the lower end of the upper part of the feed tube must both be sealed to the cap adding complexity to the design, and providing potential leakage paths. Also, while the narrow orifice makes it more difficult to refill the container, it is still quite readily possible, by providing a refill with a nozzle which replicates the shape of the upper part of the feed tube, to refill the container via the orifice and lower feed tube. Also, the design with the orifice represents something of a compromise as, in order to be most effective against refilling, the orifice should be as small as possible. However, the fact that the orifice is directly in the dispensing path means that, the smaller it is, the more difficult it will be to dispense liquid from the container.

The present invention is directed to providing an improved design of a container assembly for use with a dispenser with a feed tube and which is non-refillable.

According to a first aspect of the present invention, there is provided a container assembly for use with a dispenser with a feed tube, the assembly comprising a container; a cap fixed to an opening in the container; the cap having a passageway therethrough to allow, in use, the feed tube of a dispenser to pass through the cap and into the container; the cap including a movable element secured to the cap in a first position prior to first insertion of the feed tube by a deformable support element arranged to deform upon insertion of the feed tube into the cap to free the movable element to be supported, in use, in a second position, by the feed tube to preserve the passageway, the movable element being configured to move, upon removal of the feed tube from the container, to a third position at least partially within the passageway in which replacement of the feed tube through the cap is obstructed.

The first position is the position of the movable element before insertion of the feed tube, the second position is the position of the movable element when the feed tube is in place and the third position is the position of the movable element once the feed tube has been removed. It is possible for the movable element to be in the same position in the first and second positions if the feed tube simply moves the deformable support element out of the way.

Thus, with the present invention, the feed tube can normally pass through the cap and into the container, thereby avoiding the problems associated with the two-part feed tube. By having a movable element which moves to obstruct the passageway once the feed tube is removed, there is no need to provide a narrow orifice. This allows the normal operation of the dispenser to proceed largely unobstructed. Also, a movable element which obstructs the feed tube path prevents re-use in two ways. Firstly, it makes it more difficult for refill liquid to be introduced into the container and, secondly, it prevents reinsertion of the feed tube. It is therefore more effective as a means of preventing re-use.

The arrangement of the present invention is particularly suited to a container assembly which is sold as a refill without the dispenser and associated feed tube in place. When a user inserts the feed tube of a spray assembly, this will deform the deformable support element, either moving it or breaking it, hence, preventing subsequent re-use of the container once the feed tube is removed.

The deformable support element may either be flexible so that it is pushed out of the way by the feed tube, or it may be the frangible element which is broken off by the feed tube.

In the case of the flexible element, the feed tube can bear directly against the deformable element to push it out of the way.

In the case of a frangible element, preferably the movable element is provided with an obstruction arranged in the passageway in the first position such that the feed tube pushes against this obstruction in order to generate sufficient force to break the frangible element, the obstruction being held in place by a second frangible element arranged to break at a greater force than that required to break the frangible element securing the movable element to the cap. Thus, on insertion of the feed tube, the feed tube will push against the obstruction thereby breaking the frangible element holding the frangible element to the cap and will subsequently break the second frangible element. The obstruction may be configured to break off entirely from the movable element, or may be additionally held in place by a hinge so that it is pushed by the feed tube breaking the second frangible element thereby allowing the obstruction to pivot around the hinge out of the passageway. This ensures that the obstruction does not represent a loose element which may block the feed tube.

The movable element may be a spring-loaded element held in the second position against a resilient biasing force, in use, by the feed tube. The spring-loaded element may take the form of a pair of arms which are resiliently biased against the feed tube in the second position, but which will interlock with one another when the tube is removed to prevent re-insertion of the feed tube.

As an alternative to the spring-loaded element, the movable element may have a passage therethrough, through which, in use, the feed tube passes.

The movable element is preferably unstable in the second position with the feed tube removed. Upon removal of the feed tube, it will naturally move to the third position in which its passage is out of alignment with the passageway through the cap.

In this case, the movable element may be a sphere in which the passage does not pass through the centre of the sphere, and wherein the lower surface of the cap is domed to ensure that the sphere rolls away from the centre of the cap to the third position. The movable element may have a substantially conical lower surface so that, in use, with the feed tube removed, it comes to rest in the third position with its passage at an angle to the passageway. The movable element may be a disc with an oblique passage which is retained, in use, by the feed tube in the second position and which subsequently falls, upon removal of the feed tube, into the third position in an orientation in which the oblique passage prevents re-insertion of the feed tube.

The present invention also extends to a dispenser comprising a combination of a feed tube and a container assembly according to a first aspect of the present invention, the dispenser being attached to the container assembly such that the feed tube passes through the passageway in the cap to retain the movable element in the second position.

Examples of a container assembly in accordance with the present invention will now be described with reference to the accompanying drawings, in which.

The container assembly shown in FIG. 1 comprises a container 1 in the neck of which a cap 2 is fixed. The cap may be glued or welded in place or may be a snap-fit that cannot be readily removed by a consumer without damaging the cap and/or container.

Figure 1A:
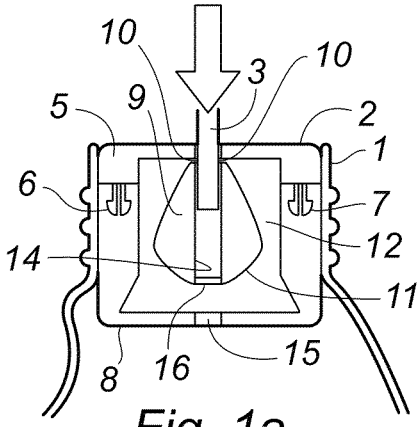
FIGS. 1A-1E are cross-sections through the top of the container assembly, and feed tube showing various stages from initial assembly to the removal of the feed tube and finally an attempt to reinsert a feed tube.
Figure 1B:
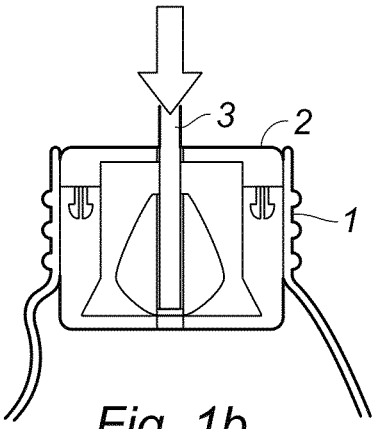
Figure 1C:
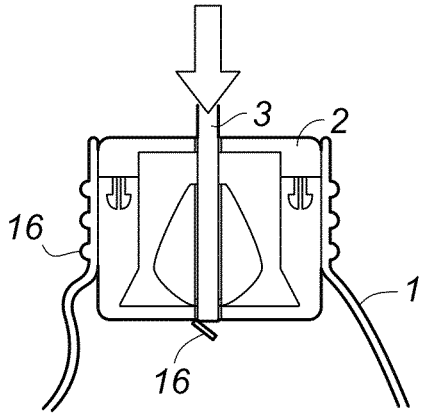
Figure 1D:
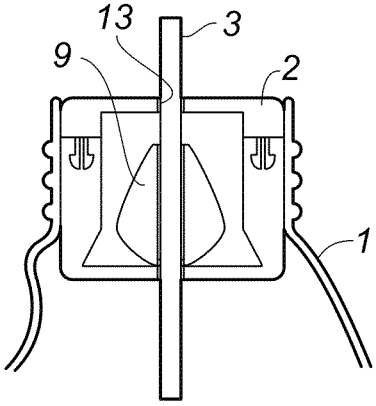

Also shown in FIG. 1 is a feed tube 3 which is inserted through the cap (FIG. 1D). When used in the orientation shown, the feed tube 3 is a dip tube long enough that its lower end approaches the lower end of the container. In other orientations, the tube may extend to a different position to best enable dispensing. For example, if designed for use in an inverted configuration, the feed tube needs only to be long enough to penetrate the cap.

The cap 2 in FIG. 1 is made of a two-part construction with an upper part 5 having spigots 6 which snap into complementary recesses 7 in a lower cap 8. Attached to the lower wall of the upper part 5 is a movable element 9 in a first position. This is attached by frangible members 10. The movable element has a generally truncated conical lower surface 11 and a generally truncated conical upper surface 12 forming the generally teardrop-like shape shown in FIG. 1. A feed tube passageway is provided through the centre of the cap. This takes the form of an opening 13 in the upper part 5 of the cap, a throughbore 14 through a movable element 9 and an opening 15 in the lower part of the cap 8. These two openings 13, 15 and the throughbore 14 are aligned along the centre of the cap. The movable element 9 is provided in its throughbore 14 with a removable element 16 which may be a bar, cross piece or disc which has a frangible connection at its outer periphery to the movable element 9.

In use, the feed tube 3 is inserted into the movable element 9 via the opening 13 as shown in FIG. 1. The feed tube 3 abuts against the removable element 14 and downward pressure causes the frangible element 10 to break, thereby freeing the movable element 9 as shown in FIG. 1B. Further downward pressure on the feed tube breaks the frangible connection between the removable element 16 and the throughbore 14 as shown in FIG. 1C, allowing the feed tube 3 to penetrate fully into the container until it reaches the at use position shown in FIG. 1D. The movable element 6 is in the second position.

Figure 1E:
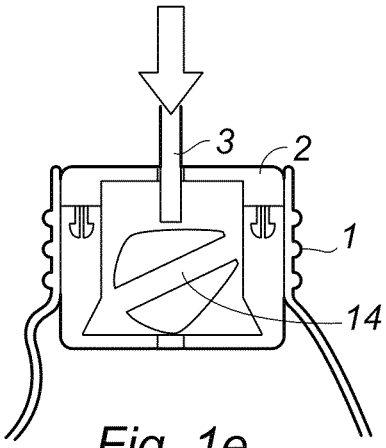

When the feed tube 3 is removed, the movable element 9 is retained within the cap and falls over into the third position such as the position shown in FIG. 1E where the throughbore 14 is no longer aligned with the openings 13, 15 thereby providing an obstruction to any attempt to reinsert the feed tube 3.

The cap is shown with a screw thread connection 16. This receives a dispenser with a complimentary screw thread. The dispenser may, for example, be a trigger spray of the kind well known in the art. The screw connection may be replaced by any other type of connection such as a clip-on or bayonet connection.

Figure 2A:
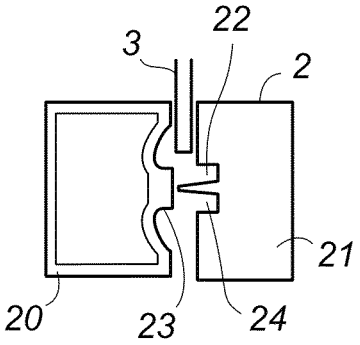
FIGS. 2A-2C are similar cross-sections of a second example.
Figure 2B:
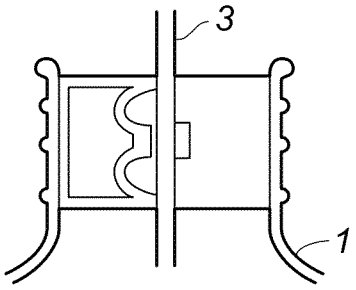
Figure 2C:
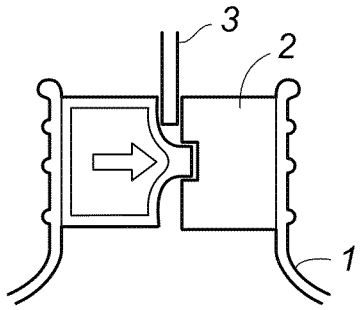

A second example is shown in FIGS. 2A-2C. In this case, the cap 2 comprises a left-hand portion 20 and a right-hand portion 21 which are joined together. The inner face of the right-hand portion 20 is resiliently deformable representing the movable element and is held in the first position against its resilient biasing force in the position shown in FIG. 2A by a frangible or deformable tongue 22 on the right-hand portion. When the feed tube 3 is inserted it bends or breaks the frangible tongue 22 such that the resilience in left-hand portion 20 is now held in place in the second position by the feed tube 3. When the feed tube 3 is released, the resilient force acting on the left-hand portion of the cap 2 causes it to move to the right to the third position. A projection 23 on the right-hand portion 20 enters a recess 24 on the right-hand portion thereby obstructing subsequent re-insertion of the feed tube 3 as shown in FIG. 2C.

Figure 3A:
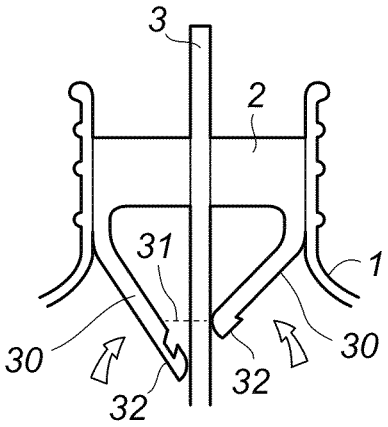
FIGS. 3A and 3B are similar cross-sections of a third example.
Figure 3B:
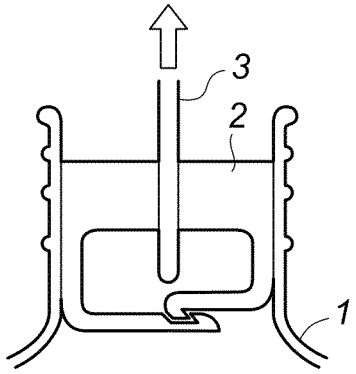

In FIGS. 3A and 3B, the cap 2 is a one-piece construction provided with a pair of resilient legs 30 representing movable elements. These are initially held apart in the first position by a frangible member 31 and are then held apart in the second position against their resilience by the feed tube 3. At the lower ends of the legs 30 are complementary interlocking means 32. When the feed tube 3 is released, the resilient forces acting on the legs 30 cause the legs to move upwardly and inwardly to the third position shown in FIG. 3B where the interlocking means 31 interlock and prevent the reinsertion of the feed tube 3.

Figure 4A:
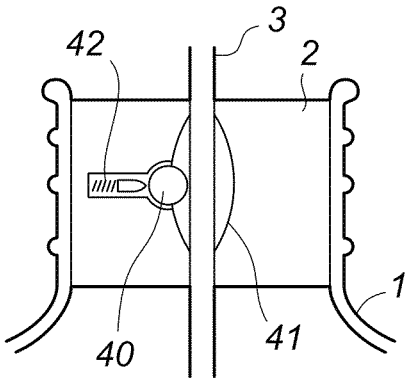
FIGS. 4A and 4B are similar cross-sections of a fourth example.
Figure 4B:
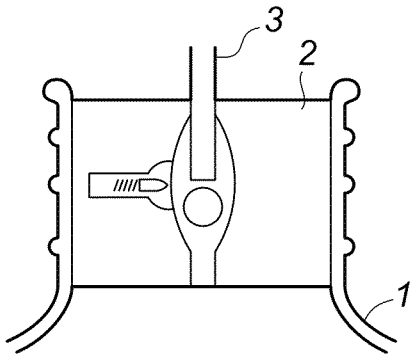

As shown in FIGS. 4A and 4B, the movable element is a ball 40 which is resiliently biased towards a cavity 41 by a spring 42. This is initially retained in the first position by a member (not shown) similar to tongue 22 in FIG. 2.

In normal operation, the feed tube 3 holds the ball 40 in the second position shown in FIG. 4A. However, as soon as the feed tube 3 is removed, the ball is pushed by the spring 42 into the cavity 41 to a position in which it will block the passageway through the cap.

Figure 5A:
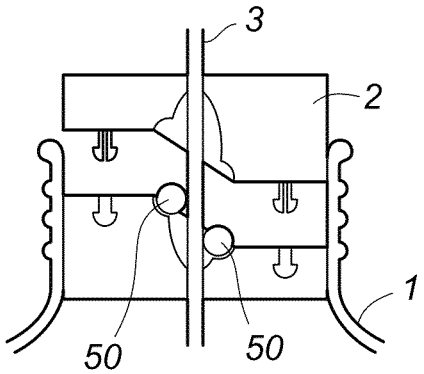
FIGS. 5A and 5B are similar cross-sections of a fifth example.
Figure 5B:
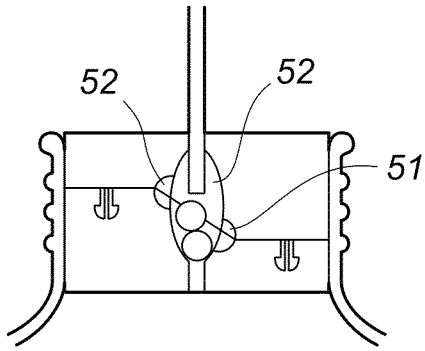

In FIGS. 5A and 5B, the two-part cap is assembled around the feed tube 3 with a pair of balls 50 in complementary recesses 51 within the cap. The balls are held in the first position by tongues (not shown) similar to tongues 22 in FIG. 2. In this case, the balls are not resiliently biased, but rely on gravity so that, once the feed tube 3 is removed, they fall into the central cavity 52 as shown in FIG. 5, to a position in which they obstruct the passageway through the cap.

Figure 6A:
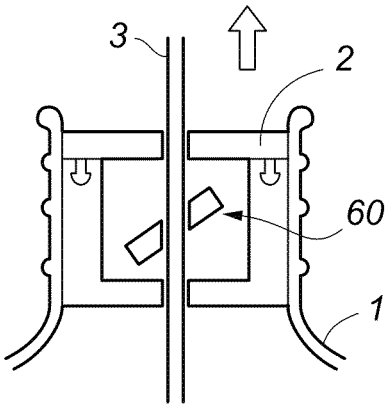
FIGS. 6A and 6B are similar examples of a sixth cross-section.
Figure 6B:
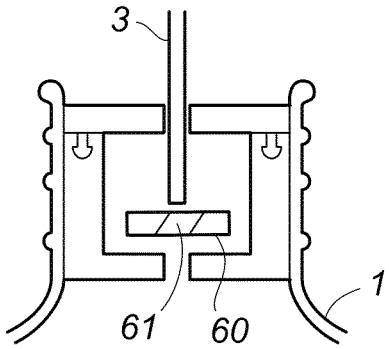

In FIG. 6, a two-part cap is provided with a disc 60 with an oblique throughbore 61 through which the feed tube 3 is threaded. The disc is initially held in place in the first position by a frangible member (not shown) similar to frangible members 10 in FIG. 1. It may also have a removable element corresponding to removable element 16 in FIG. 1. When the feed tube 3 is removed as shown in FIG. 6B, the oblique throughbore is out of alignment with the passageway obstructing the feed tube 3 in the third position.

Figure 7A:
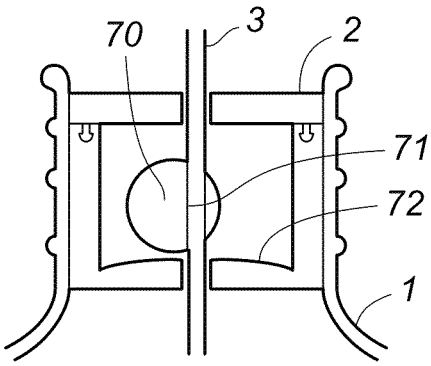
FIGS. 7A and 7B are similar cross-sections of a seventh example.
Figure 7B:
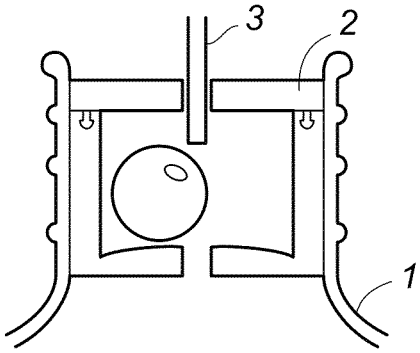

In FIGS. 7A and 7B, the movable element is a ball 70 with an eccentric throughbore 71 through which the feed tube 3 is threaded. The ball is initially held in place in the first position by a frangible member (not shown) similar to frangible members 10 in FIG. 1. It may also have a removable element corresponding to removable element 16 in FIG. 1. The lower surface 72 of the interior of the cap 2 is domed so as to be higher in the centre than at the edge. When the feed tube 3 is removed, the ball 70 will roll to one side of the cap to the third position such that the throughbore 71 is out of alignment with the passageway through the cap, so that the ball 70 now blocks this passageway.

Figure 8A:
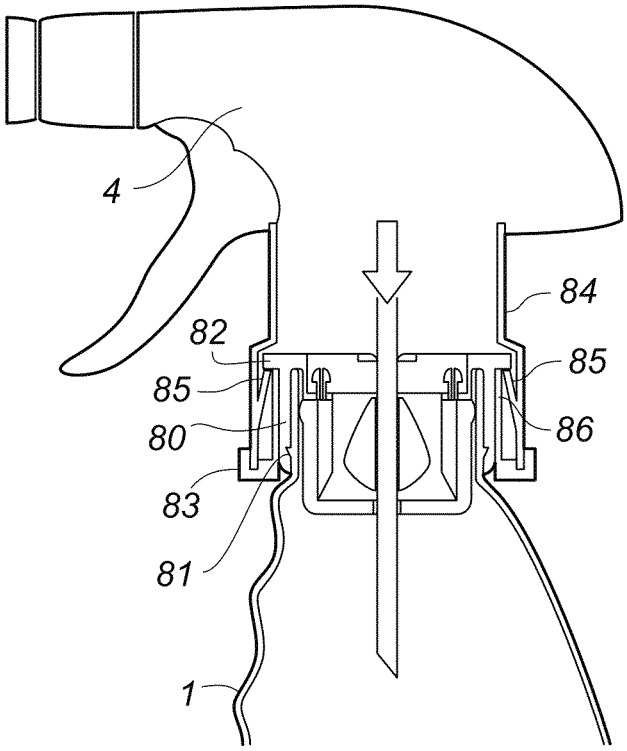
FIGS. 8B and 8B are cross sections through a container comprising the container assembly of FIGS. 1A and 1B in the neck of the container and further comprising a release mechanism for a trigger spray.
Figure 8B:
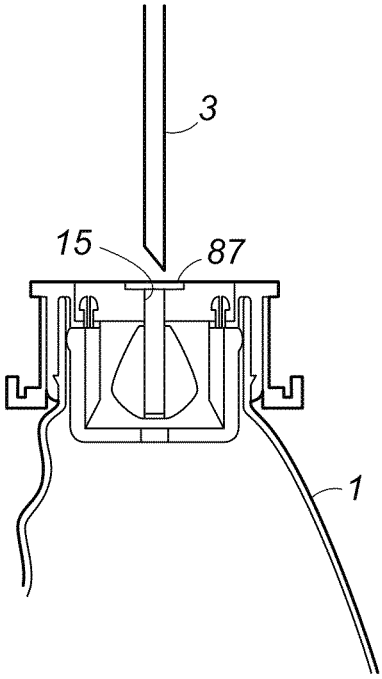

In FIGS. 8A and 8B the container assembly of FIGS. 1A to 1E is shown placed in the neck of a container 1. In FIG. 1A a trigger spray 4 comprising a feed tube is releasably attached to the neck of the container 1. The container assembly comprises a downwardly extending collar 80 which extends around the circumference of the container assembly and which contacts the outer surface of the neck of the container 1. The collar 80 comprises a recess on its inwardly facing surface which connects with a ridge 81 protruding from the outwardly facing surface of the neck of the container 1. The container assembly further comprises an outwardly extending platform 82 which extends outwardly beyond the collar 80. Beneath this platform 82 there is a downwardly extending bracket 83 which extends around the circumference of the container assembly and on its vertical inwardly facing surface abuts the outwardly facing surface of the collar 80 and on its uppermost surface abuts the underside of the platform 82. The container assembly is releasably connected to a circumferentially and downwardly extending connecting portion 84 of the trigger spray 4. An upwardly extending branch 85 of the connecting portion 84 of the trigger spray 4 connects with the underside of the platform 82 to secure the trigger spray 4 in place on the neck of the container 1. The lowermost end of the connecting portion 84 contacts a recess in the bracket 83. At least one part of the branch 85 comprises a frangible part 86 which is broken when the trigger spray comprising the connecting portion 84 is removed from the container 1.

In FIG. 8B the container assembly is inserted into the neck of a container 1. The opening 13 is closed by a frangible cover 87. To insert a feed tube 3 into the opening the tube 3 is pushed through the frangible cover 87.

The invention claimed is:

1. A container assembly adapted for use with a dispenser with a feed tube, the assembly comprising: a container; a cap fixed to an opening in the container; the cap having a passageway therethrough to allow, in use, the feed tube of a dispenser to pass through the cap and into the container; the cap including a movable element secured to the cap in a first position prior to first insertion of the feed tube by a deformable support element arranged to deform upon insertion of the feed tube into the cap to free the movable element to be supported, in use, in a second position, by the feed tube to preserve the passageway, the movable element being configured to move, upon removal of the feed tube from the container, to a third position at least partially within the passageway in which replacement of the feed tube through the cap is obstructed.

2. A container assembly according to claim 1, wherein the deformable element is a frangible element.

3. A container assembly according to claim 2, wherein the movable element is provided with an obstruction arranged in the passageway in the first position such that the feed tube pushes against this obstruction in order to generate sufficient force to break the frangible element, the obstruction being held in place by a second frangible element arranged to break at a greater force than that required to break the frangible element securing the movable element to the cap.

4. A container assembly according to claim 1, wherein the movable element has a passage therethrough, through which, in use, the feed tube passes.

5. A container assembly according to claim 4, wherein the movable element is unstable in the second position with the feed tube removed.

6. A container assembly according to claim 4, wherein the movable element has a substantially conical lower surface so that, in use, with the tube removed, it comes to rest with its passage at an angle to the passageway.

7. A dispenser comprising a combination of a feed tube and a container assembly according to claim 1 and a dispenser attached to the container assembly such that the feed tube passes through the passageway in the cap to retain the movable element in the second position.

* * * * *